US007302906B2

(12) United States Patent
Burroughs et al.

(10) Patent No.: US 7,302,906 B2
(45) Date of Patent: Dec. 4, 2007

(54) BOAT CONSTRUCTION WITH STOWABLE SEAT

(75) Inventors: Ken Burroughs, Springfield, MO (US); Tommy F. Morphis, Springfield, MO (US)

(73) Assignee: Tracker Marine, L.L.C., Springfield, MO (US)

( * ) Notice: Subject to any disclaimer, the term of this patent is extended or adjusted under 35 U.S.C. 154(b) by 0 days.

(21) Appl. No.: 11/616,708

(22) Filed: Dec. 27, 2006

(65) Prior Publication Data

US 2007/0151501 A1 Jul. 5, 2007

Related U.S. Application Data

(60) Provisional application No. 60/755,648, filed on Dec. 30, 2005.

(51) Int. Cl.
*B63B 17/00* (2006.01)

(52) U.S. Cl. ..... 114/363

(58) Field of Classification Search ..... 114/363
See application file for complete search history.

(56) References Cited

U.S. PATENT DOCUMENTS 2,112,087 A * 3/1938 Golod et al. ..... 312/204
3,570,029 A * 3/1971 Hunsaker ..... 114/362
4,738,217 A 4/1988 Smith
5,136,963 A 8/1992 Zuzik
5,421,131 A * 6/1995 Heckman et al. ..... 52/263
5,497,724 A 3/1996 Brown et al.
5,697,318 A * 12/1997 Kobayashi ..... 114/343
5,799,605 A * 9/1998 Huse ..... 114/363
D441,461 S * 5/2001 Bryjak et al. ..... D25/63
6,283,059 B1 9/2001 Scully, Jr.
2003/0196582 A1* 10/2003 Neese et al. ..... 114/363
2007/0035166 A1* 2/2007 Summerford ..... 297/331

* cited by examiner

*Primary Examiner*—Stephen Avila
(74) *Attorney, Agent, or Firm*—Blackwell Sanders LLP

(57) ABSTRACT

A boat having a jump seat is provided. The boat includes a boat hull having a recessed passenger compartment. The jump seat includes a support assembly comprising a support deck and a sleeve. A seat cushion is provided for selectively resting on a portion of the deck assembly and being stowed within the pocket. The deck assembly can be used both as a seat support and as a standing deck eliminating the need to stand on a cushion to thereby provide a more stable convertible standing area.

11 Claims, 3 Drawing Sheets

BOAT CONSTRUCTION WITH STOWABLE SEAT

CROSS-REFERENCE TO RELATED APPLICATION

This application claims the benefit of and priority to U.S. Provisional Patent Application No. 60/755,648, filed Dec. 30, 2005, entitled BOAT CONSTRUCTION WITH STOWABLE SEAT, which document is hereby incorporated by reference to the extent permitted by law.

BACKGROUND OF THE INVENTION

Small boats such as runabouts and fishing boats are well known. These boats will typically have a length on the order of about 12 to about 22 feet. Such boats are typically well appointed with features and in particular a variety of types and locations of seats. Many of the seats are designed to provide a variety of uses in a variety of locations. Examples of these seats may be found in U.S. Pat. Nos. 4,738,217, 5,136,963, 5,497,724 and 6,283,059. The seats or decks disclosed therein provide certain advantages along with certain disadvantages. It is noted that a seat may also function as a deck and a deck may also function as a seat. For example, U.S. Pat. No. 6,283,059 discloses a deck construction that is convertible to a seat. It uses a complex construction utilizing hinge pins and grooves for effecting movement and securement of one portion of the deck either in a deck forming position or a seat back position. U.S. Pat. No. 5,136,963 discloses a deck extension that is movable from a deck forming position to a stowed position over the stem of the boat. It utilizes a complex series of arms, pivots and hinges. U.S. Pat. No. 4,738,217 discloses a stem seat that can be converted to a casting platform. It to uses a complex series of hinges and seat components. U.S. Pat. No. 5,497,724 discloses a boat construction having a jump seat with a cushion that can be used at one of two elevations to provide either seating or as a sun pad.

While such constructions are useful, they are complicated structures, large, cumbersome, expensive or lacking in versatility. Such constructions may also require complex movements to operate. Another problem with such structures is their retention in their various orientations. Some such seat structures utilizes the weight of the seat or deck portion solely as the means for retaining them in a selected orientation. Boats are often subjected to harsh rides in choppy water and if components of the boat and articles in the boat are not restrained, they are subjected to large and potentially damaging forces from the choppy rides.

There is thus a need for an improved seat construction wherein the seat may be securely stowed for periods of non use providing walking and standing deck portions and may be easily moved between a secure stowed position and a secure use position.

BRIEF SUMMARY OF THE INVENTION

The present invention involves the provision of a boat construction with stowable seat. The boat construction includes a hull which will include a recessed passenger compartment, an interior floor and gunnels. A sleeve is provided having an open end opening into a storage pocket or compartment at an elevation between the floor and gunnels. A deck member is adjacent to and extending away from the open end of the pocket. The deck has an upwardly facing surface on which a seat cushion may be placed for support. A seat cushion is provided having a bottom portion adapted to rest on the upwardly facing surface of the deck portion to selectively provide a seat. The seat cushion may be selectively moved into the pocket for retention therein whereby the deck portion is exposed to be used as a walking, stepping, or standing surface. Interengagable members are provided and are operable to selectively and releasably retain the seat cushion in at least its stowed position and preferably in its stowed position and its extended seat forming position.

BRIEF DESCRIPTION OF THE SEVERAL VIEWS OF THE DRAWINGS

Like numbers throughout the various Figures designate like or similar parts or construction.

DETAILED DESCRIPTION OF THE INVENTION

Figure 1:
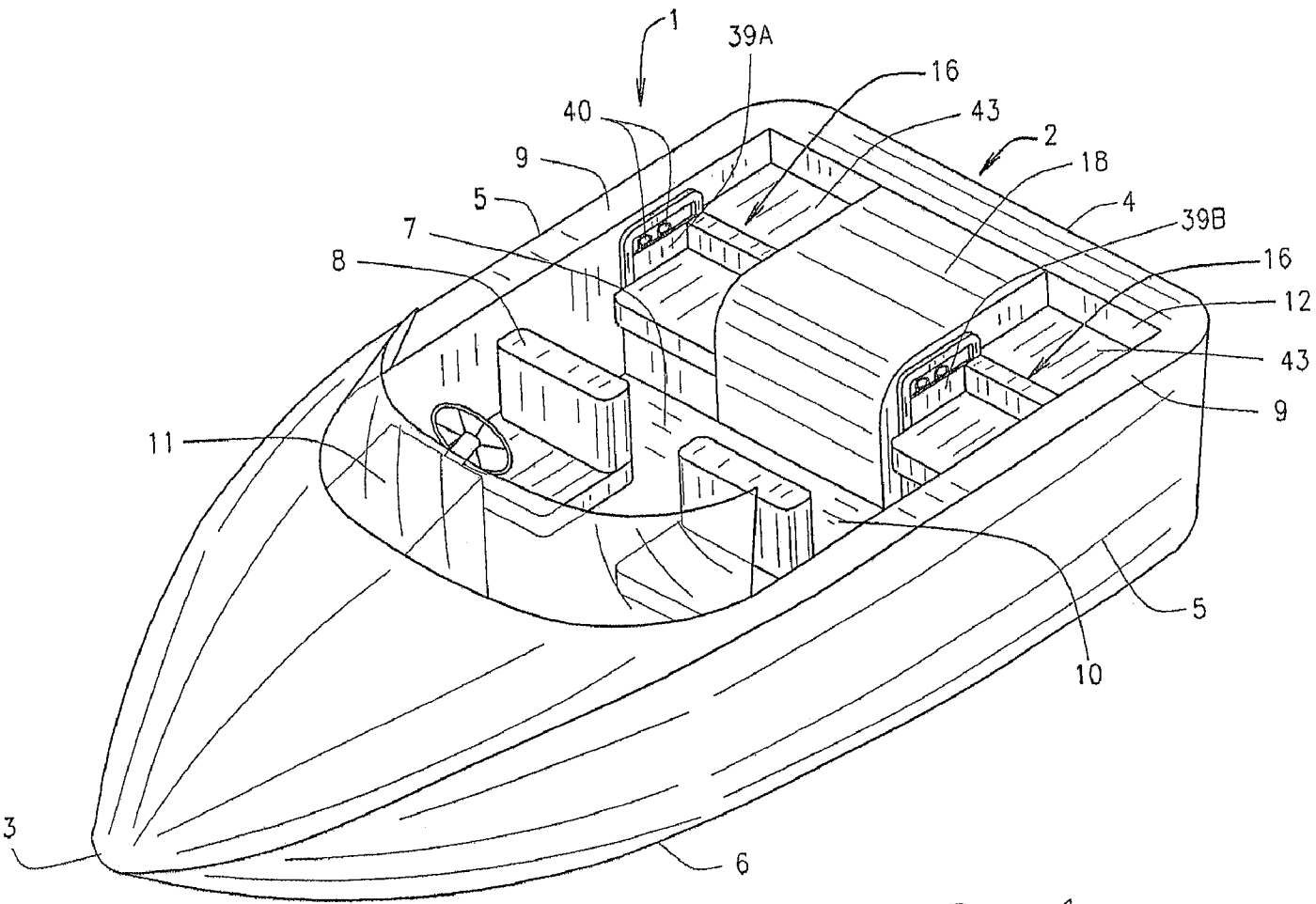
FIG. 1 is a perspective view of a boat construction as viewed generally from above the boat.

The reference numeral 1 designates generally a boat having a hull 2 with a bow portion 3, stern portion 4, sidewalls 5, a bottom 6 and an interior floor 7. The hull 2 further includes gunnels 9 along the top edges of the sidewalls 5. The gunnels are spaced from the interior floor 7. The hull 2 includes a recessed passenger compartment 10 which may be appointed with such things as seats 8, console 11, instrumentation, storage and various assorted items as are known in the art. The compartment 10 is accessible via a top opening 12. The top opening 12 may be substantially the same size as the hull 2 or smaller by the provision of a covered bow or a partially covered stem. The boat 1 may also be of a walk thru design. The hull 2 may be a deep draft or shallow draft as desired. There is a provision in the boat 1 for some motive source which is preferably a motor which can be an inboard, and inboard/outboard or an outboard motor as desired. In the event of an outboard, a transom at the stem portion 4 may be provided. A motor may be contained in housing 18.

Figure 2:
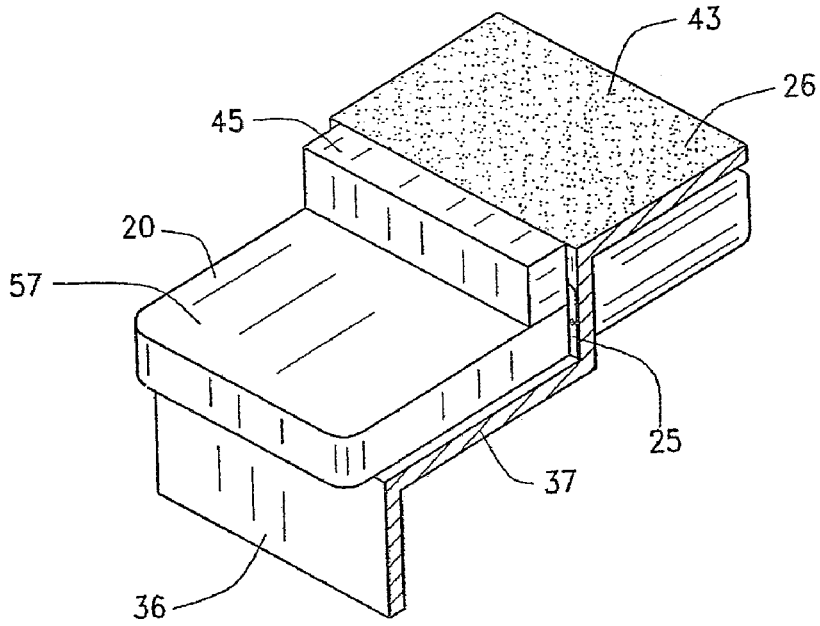
FIG. 2 is a fragmentary view of the stowable seat construction with a seat cushion in a position for use as a seat.
Figure 3:
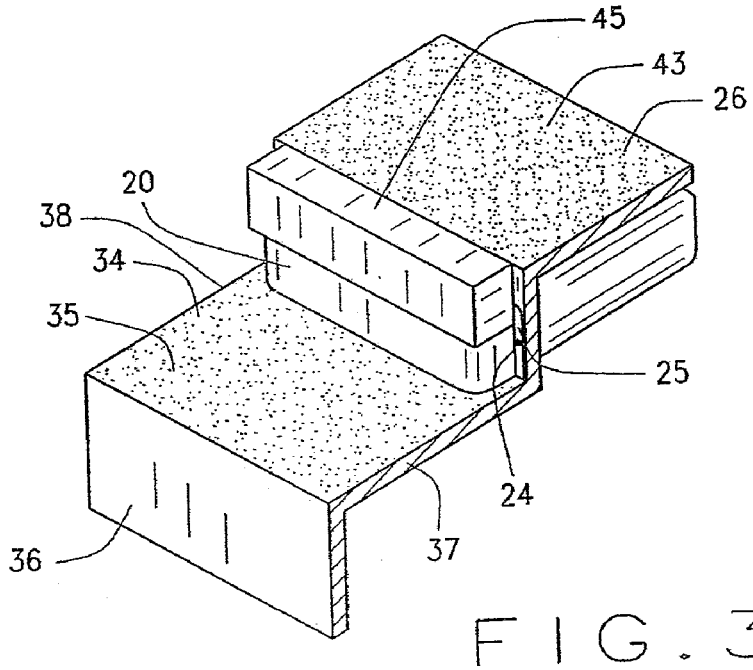
FIG. 3 is a fragmentary view similar to FIG. 2 but with the seat cushion in a stowed position.
Figure 4:
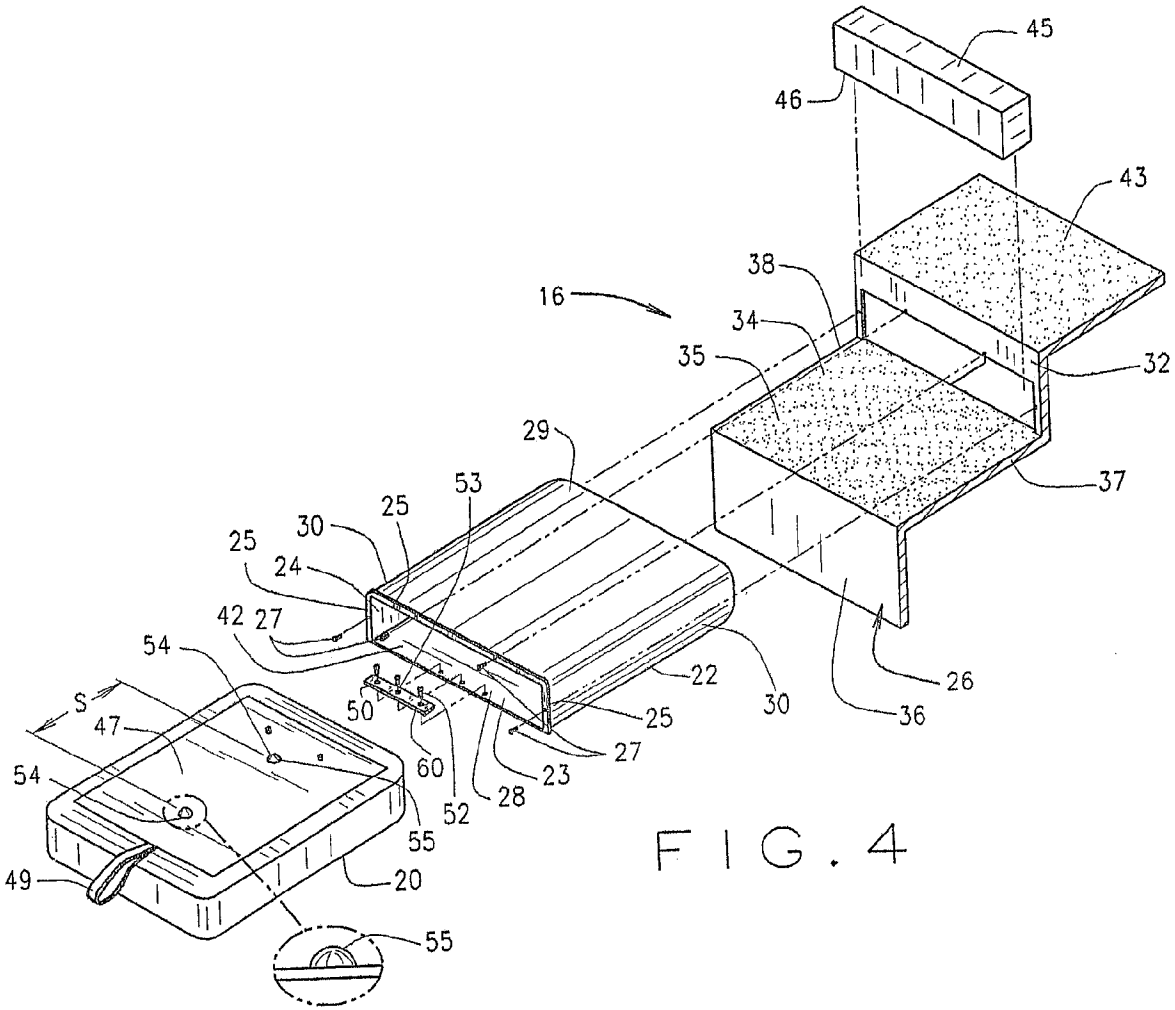
FIG. 4 is an exploded fragmentary perspective view of the seat, the seat cushion being shown upside down to show details thereof.

The present invention includes a stowable seat assembly such as a jump seat the details of which are best seen in FIGS. 2-4. The seat assembly is designated generally 16 and may be positioned at any suitable location within the compartment 10 of hull 2. As seen, a seat 16 is positioned adjacent the stem 4 on one side of the housing 18. The boat 1 may include a plurality of seats 16 and, as shown, there are two, one on each side of the housing 18. A seat 16 is operable to allow a seat cushion 20 to be selectively moved between a stowed position, FIG. 3, and a seating position, FIG. 2, as more fully described below. The seat 16 includes a sleeve 22 forming a generally horizontally extending pocket 23 having an access opening 24. (Position and orientation references are used herein as if the boat were floating level in still water.) In the illustrated structure, the sleeve 22 includes a mounting flange 25 that is suitably secured to a deck assembly 26 as by gluing or as illustrated, with one or more mechanical fasteners 27 such as rust resistant screws. The sleeve 22 preferably includes a bottom wall 28, top wall 29 and sidewalls 30 preferably formed as an integral structure as by molding. In a preferred embodiment, the back side (not shown) of the sleeve 22 may be either closed or open to facilitate the manufacture thereof. As shown, the flange 25 extends outwardly from the top wall 29 and the sidewalls 30 and overlies a portion of an upstanding wall 32 of the deck assembly 26.

In the illustrated structure, the deck assembly 26 is secured to portions of the boat 1 and includes a generally horizontal deck or floor member 34 having an exposed surface 35 that is preferably textured to provide a slip resistant surface on at least a substantial portion thereof. The texture may be molded in with the floor member or may be an applied coating or may be an attached layer of slip resistant material. The floor member 34 is positioned in the hull 2 at an elevation between those of the interior floor 7 and the gunnels 9. As shown, the floor member 34 extends between the respective sidewall 5 and the engine housing 18 and is positioned at an elevation from the interior floor 7 suitable for seating when a seat cushion 20 is positioned thereon. As shown, the deck assembly 26 also includes a wall 36 that extends upwardly from the floor 7 to the floor member 34 to provide support for the front portion of the floor 34. The floor 34 is suitably supported on opposite sides 37, 38 thereof as by connection to portions of the hull 2. Side cushions 39A, 39B may be provided for arm support or the like when the seat assembly 16 is being used as a seat. Cup holders and other storage devices 40 may also be provided adjacent to a seat 16 for the convenience of the seat user. The flange 25 is preferably secured to the wall 32 that extends between the floor member 34 and a second generally horizontal deck or floor member 43 which can be utilized as a second step or deck. The floor member 43 may also be provided with a textured surface for slip resistance as described above for the floor member 34. Either of the floor members 34 or 43 may be used as a platform for standing and provide a solid generally inflexible surface for standing, kneeling or the like or even sitting. The use of a cushion to stand on can be unstable depending on its hardness and size. The walls 32, 36 and floor members 34, 43 are preferably formed as an integral structure, as by molding, and suitably mounted as an assembly within the boat hull 2 and secured in place as by adhesion. The deck assembly 26 may be formed of a resin infused fibrous material as for example fiberglass as is known in the art. A seat back 45 may be secured to the wall 32 projecting therefrom and over the opening 24. The bottom portion 46 of the seat back 45 may be positioned within the opening 24 for purpose later described. Preferably, the seat back 45 can have a fabric cover and a foam core, such as vinyl covered resilient foam material providing resilient deformation as can the cushion 20.

The seat cushion 20, is preferably sized and shaped such as to rest on the upper surfaces 35, 42 of the floor member 34 and wall 28 respectively, and project upwardly therefrom. It is preferred that the floor member surface 35 and wall surface 42 be substantially co-extensive to provide a substantially continuous upwardly facing surface to facilitate support and movement of the cushion 20 in a generally horizontal plane between stowed and extended positions. The length, width and thickness of a cushion 20 are selected for the particular size seat and amount of cushioning as desired. Preferably, the seat cushion 20 has a relatively rigid back or bottom 47 (FIG. 4) that will overlie the floor member 34 and wall 28.

Means is provided for limiting the movement of the seat cushion 20 into and out of the pocket 23. The seat cushion 20 moves substantially in a plane generally linearly and horizontally throughout its movement between its stowed and seat forming (extended) positions wherein a substantial portion of the surface 35 is exposed. As shown, interengagable members are operable to selectively retain the seat cushion in at least its stowed position wherein a substantial portion of the seat cushion 20 is positioned within the pocket 23. A handle device 49, as for example, a vinyl loop can be secured to the front portion of the seat cushion 20 to facilitate movement of the seat cushion 20 from its stowed position to its seat forming position overlying a substantial portion of the floor member 34. The interengagable members, as shown, includes a bar type stop 50 which is suitably secured to one or both of the floor member 34 and the bottom wall 28 of the sleeve 22. As shown, a portion of the floor member 34 underlies a portion of the bottom wall 28 wherein there are overlapping end margin portions. Mechanical fasteners 52 such as screws may be used to extend through the stop 50, a portion of the floor member 34 and a portion of the bottom wall 28 to secure the stop in place. Alternatively, the stop 50 may be adhesively secured in place. The stop 50 has a shoulder 53 on the pocket side thereof. The interengagable members also include a pair of longitudinally spaced projections 54 that may have heads 55 with an inclined surface, for example domed or half round heads. The projections 54 are fastened to and project from the seat bottom 47. The longitudinal spacing S between the projections 54 is such as to provide for the desired amount of longitudinal movement of the seat cushion 20 into and out of the pocket 23. The projections 54 releasably limit the amount of movement of the seat cushion 20 by acting against the stop 50. Friction between the seat cushion 20 and the floor member 34 and optionally between the back 45 and the top surface 57 of the cushion 20 may also be used to restrict or resist movement of the seat cushion 20. Because the seat cushion 20 has a resilient member therein, the resilience of the cushion can be used to resist the projections 54 from moving over the stop 50. The heads 55 of the projections 54 can provide a camming action to permit the seat cushion and its projection 54 to move into and out of the pocket 23 past the stop 50. The front edge 60 of the stop 50 may be beveled or otherwise inclined to facilitate movement of the cushion 20 into the pocket 23. Bouncing of the seat cushion into and out of engagement with the floor member 34 may also be limited by the resilient engagement between the seat back 45 and the seat cushion 20 which engagement may also be used to retain the cushion 20 in a selected position.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A boat construction with seat, said boat construction comprising:

a hull with a recessed passenger compartment, an interior floor and gunnels;

a pocket with an open end and opening into the passenger compartment at an elevation between the floor and gunnels;

a deck assembly including a first deck adjacent to and extending away from the pocket open end, said first deck having an upwardly facing first surface;

a seat cushion having a bottom portion adapted to rest on the first surface to selectively provide a seat when in a first position, said seat cushion being selectively movable generally linearly between the first position and a second position where a substantial portion of the seat cushion is positioned within the pocket exposing a substantial portion of the first surface; and interengagable members operable to selectively retain the seat cushion in at least the second position.

2. The boat of claim 1 wherein the first deck being generally horizontal and the first surface having at least a substantial portion thereof in a slip resistant condition.

3. The boat of claim 2 wherein the pocket being formed by a sleeve positioned adjacent said first deck.

4. The boat of claim 3 wherein the sleeve having a bottom wall that has an upwardly facing second surface substantially coextensive with the first surface.

5. The boat of claim 4 wherein the sleeve including a pair of side walls projecting upwardly from the bottom wall and a top wall spaced from the bottom wall and extending between the side walls.

6. The boat of claim 3 wherein the deck assembly including a second deck with a generally upwardly facing third surface and including a first wall extending between the first and second decks, said first wall having a through opening with a portion of the sleeve positioned therein, a portion of the sleeve being positioned under the second deck.

7. The boat of claim 6 wherein the first deck, second deck and first wall being an integral structure.

8. The boat of claim 6 wherein the deck assembly and sleeve each being of molded construction.

9. The boat of claim 6 wherein the interengagable members including a pair of spaced apart projections secured to and projecting from the bottom portion of the seat cushion.

10. The boat of claim 9 wherein the interengagable members including a stop member projecting upwardly from at least one of the first deck and the sleeve for selective engagement with the projections.

11. The boat of claim 6 including a seat back cushion positioned above the seat cushion and mounted to the deck assembly.

* * * * *